US010947612B2

(12) United States Patent
Xu et al.

(10) Patent No.: US 10,947,612 B2
(45) Date of Patent: Mar. 16, 2021

(54) HIGH STRENGTH, FLOWABLE, SELECTIVELY DEGRADABLE COMPOSITE MATERIAL AND ARTICLES MADE THEREBY

(71) Applicants: Zhiyue Xu, Cypress, TX (US); Bobby J. Salinas, Houston, TX (US); Zhihui Zhang, Katy, TX (US)

(72) Inventors: Zhiyue Xu, Cypress, TX (US); Bobby J. Salinas, Houston, TX (US); Zhihui Zhang, Katy, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 785 days.

(21) Appl. No.: 14/641,948

(22) Filed: Mar. 9, 2015

(65) Prior Publication Data

US 2016/0265094 A1 Sep. 15, 2016

(51) Int. Cl.
*C22C 49/14* (2006.01)
*B22F 1/00* (2006.01)
(Continued)

(52) U.S. Cl.
CPC ..... *C22C 49/14* (2013.01); *B22F 1/0003* (2013.01); *B22F 1/0051* (2013.01);
(Continued)

(58) Field of Classification Search
CPC .... B22F 1/0003; B22F 1/0051; C22C 1/0491; C22C 29/005
See application file for complete search history.

(56) References Cited

U.S. PATENT DOCUMENTS 5,305,817 A * 4/1994 Borisov ..... B22D 1/00 164/103
2011/0132143 A1 6/2011 Xu et al.
(Continued)

OTHER PUBLICATIONS

Vanysek. "Electrochemical Series," in CRC Handbook of Chemistry and Physics, 97th Edition (Internet Version 2017), W. M. Haynes, ed., CRC Press/Taylor & Francis, Boca Raton, FL.*
(Continued)

*Primary Examiner* — Nicholas A Wang
(74) *Attorney, Agent, or Firm* — Cantor Colburn LLP

(57) ABSTRACT

A lightweight, selectively degradable composite material is disclosed. The composite material comprises a compacted powder mixture of a first powder, the first powder comprising first metal particles comprising Mg, Al, Mn, or Zn, or an alloy of any of the above, or a combination of any of the above, having a first particle oxidation potential, a second powder, the second powder comprising low-density ceramic, glass, cermet, intermetallic, metal, polymer, or inorganic compound second particles, and a third metal powder, the third metal powder comprising third metal particles having an oxidation potential that is different than the first particle oxidation potential. The compacted powder mixture has a microstructure comprising a matrix comprising the first metal particles, the second particles and third particles dispersed within the matrix, the third particles comprising a network of third particles extending throughout the matrix, the composite material having a density of about 3.5 g/cm$^3$ or less.

49 Claims, 4 Drawing Sheets

(51) Int. Cl.

| | |
|---|---|
| ***C22C 1/04*** | (2006.01) |
| ***C22C 32/00*** | (2006.01) |
| ***C22C 29/00*** | (2006.01) |
| ***C22C 29/06*** | (2006.01) |
| ***C22C 29/12*** | (2006.01) |
| ***C22C 29/16*** | (2006.01) |
| ***C22C 33/02*** | (2006.01) |

(52) U.S. Cl.

CPC ..... *C22C 1/0408* (2013.01); *C22C 1/0458* (2013.01); *C22C 1/0491* (2013.01); *C22C 29/005* (2013.01); *C22C 29/06* (2013.01); *C22C 29/12* (2013.01); *C22C 29/16* (2013.01); *C22C 32/001* (2013.01); *C22C 32/0052* (2013.01); *C22C 32/0068* (2013.01); *C22C 32/0089* (2013.01); *C22C 32/0094* (2013.01); *C22C 33/0257* (2013.01); *C22C 29/065* (2013.01); *C22C 32/0063* (2013.01)

(56) References Cited

U.S. PATENT DOCUMENTS

2011/0135530 A1 6/2011 Xu et al.
2011/0135953 A1 6/2011 Xu et al.
2011/0136707 A1 6/2011 Xu et al.
2012/0107590 A1* 5/2012 Xu ..... E21B 17/1085 428/220
2012/0276356 A1 11/2012 Xu et al.
2013/0000985 A1* 1/2013 Agrawal ..... E21B 41/00 175/87
2013/0047784 A1 2/2013 Xu et al.
2013/0047785 A1 2/2013 Xu
2013/0052472 A1 2/2013 Xu et al.
2014/0014339 A1* 1/2014 O'Malley ..... E21B 43/261 166/281
2014/0231082 A1* 8/2014 Jamison ..... E21B 21/003 166/278

OTHER PUBLICATIONS

Yih, P. et al. "A comparative study of the coated filler method and the admixture method of powder metallurgy for making metal-matrix composites." 1997. Journal of Materials Science. 32. p. 2873-2882 (Year: 1997).*

"Density of polymers." 2014. Scientific polyer. Retrieved from: http://scientificpolymer.com/density-of-polymers-by-density/ (Year: 2014).*

Slipenyuk, A. et al. "Properties of P/M processed particle reinforced metal matrix composites specified by reinforcement concentration and matrix-to-reinforcement particle size ratio." 2006. Acta Materialia. 54. p. 157-166 (Year: 2006).*

Cochran, J. "Ceramic hollow spheres and their applications." 1998. Current Opinion in solid state and materials science. 3. p. 474-479. (Year: 1988).*

Maisano, "Cryomilling of Aluminum-Based and Magnesium-Based Metal Powders", Thesis, Virginia Tech, Jan. 13, 2006; 73 pages.

Seyni, et al., "On the interest of using degradable fillers in co-ground composite materials", Powder Technology 190, (2009) pp. 176-184.

* cited by examiner

HIGH STRENGTH, FLOWABLE, SELECTIVELY DEGRADABLE COMPOSITE MATERIAL AND ARTICLES MADE THEREBY

BACKGROUND

Oil and natural gas wells often utilize wellbore components or tools that, due to their function, are only required to have limited service lives that are considerably less than the service life of the well. After a component or tool service function is complete, it must be removed or disposed of in order to recover the original size of the fluid pathway for use, including hydrocarbon production, $CO_2$ sequestration, etc. Disposal of components or tools has conventionally been done by milling or drilling the component or tool out of the wellbore, which are generally time consuming and expensive operations.

Recently, in order to improve well operations and reduce costs by reducing the need for milling or drilling operations, various interventionless, selectively removable wellbore components or tools have been developed. These selectively removable components or tools include or are formed from various dissolvable, degradable, corrodible, or otherwise removable materials and can be removed from a wellbore without mechanical intervention, such as by changing the conditions in the wellbore, including the temperature, pressure or chemical constituent makeup of a wellbore fluid. While these materials are very useful, it is also very desirable that these materials be lightweight and have high strength, including a strength comparable to that of conventional engineering materials used to form wellbore components or tools, such as various grades of steel, stainless steel and other Ni-base, Co-base and Fe-base alloys. As an example, Fe-base selectively removable materials have been developed. These Fe-base removable materials are high strength and have an ultimate compressive strength of about 100 ksi at room temperature and a density of about 5.3 g/cm$^3$. While very useful, these materials are not ideal for use in certain applications, such as in horizontal portions of the wellbore, because they are more dense than the wellbore fluids and have a tendency to settle out of the fluid requiring higher fluid pressures to affect their movement or run-in into horizontal portions of the wellbore While it is very desirable to use selectively removable components and tools in all portions of a well, selectively removable components and tools are particularly desirable for use in horizontal portions of the well, since a single vertical well may include a plurality of horizontal portions at a given depth, and this plurality of horizontal portions may be established at a plurality of depths. The extensive and expanding use of horizontal drilling makes the development of improved high strength, lightweight, selectively removable materials very desirable.

Thus, the further improvement of high strength, lightweight, selectively removable materials and articles, including downhole tools and components, is very desirable.

SUMMARY

In one embodiment, a lightweight, selectively degradable composite material is disclosed. The composite material comprises a compacted powder mixture of a first powder, the first powder comprising first metal particles comprising Mg, Al, Mn, or Zn, or an alloy of any of the above, or a combination of any of the above, having a first particle oxidation potential, a second powder, the second powder comprising low-density ceramic, glass, cermet, intermetallic, metal, polymer, or inorganic compound second particles, and a third metal powder, the third metal powder comprising third metal particles having an oxidation potential that is different than the first particle oxidation potential. The compacted powder mixture has a microstructure comprising a matrix comprising the first metal particles, and the second particles and third particles dispersed within the matrix, the third particles comprising a network of third particles extending throughout the matrix, the lightweight, selectively degradable composite material having a density of about 3.5 g/cm$^3$ or less.

In another embodiment, a selectively degradable article is disclosed. The article includes a lightweight, selectively degradable composite material. The composite material includes a compacted powder mixture of a first powder, the first powder comprising first metal particles comprising Mg, Al, Mn, or Zn, or an alloy of any of the above, or a combination of any of the above, having a first particle oxidation potential, a second powder, the second powder comprising low-density ceramic, glass, cermet, intermetallic, metal, polymer, or inorganic compound second particles, and a third metal powder, the third metal powder comprising third metal particles having an oxidation potential that is different than the first particle oxidation potential. The compacted powder mixture has a microstructure including a matrix comprising the first metal particles, and the second particles and third particles dispersed within the matrix, the third particles comprising a network of third particles extending throughout the matrix, the lightweight, selectively degradable composite material having a density of about 3.5 g/cm$^3$ or less.

In yet another embodiment, a lightweight, selectively degradable composite material is disclosed. The composite material comprises a first matrix of a first metal comprising Mg, Al, Mn, or Zn, or an alloy of any of the above, or a combination of any of the above, having a first oxidation potential, a second powder, the second powder comprising low-density ceramic, glass, cermet, intermetallic, metal, polymer, or inorganic compound second particles, and a third metal powder, the third metal powder comprising third metal particles having an oxidation potential that is different than the first oxidation potential. The composite material has a microstructure comprising the matrix of the first metal; and the second particles and third particles dispersed within the matrix, the third particles comprising a network of third particles extending throughout the matrix, the lightweight, selectively degradable composite material having a density of about 3.5 g/cm$^3$ or less.

In still another embodiment, a selectively degradable article is disclosed. The article includes a lightweight, selectively degradable composite material comprising a first matrix of a first metal comprising Mg, Al, Mn, or Zn, or an alloy of any of the above, or a combination of any of the above, having a first oxidation potential; a second powder, the second powder comprising low-density ceramic, glass, cermet, intermetallic, metal, polymer, or inorganic compound second particles; and a third metal powder, the third metal powder comprising third metal particles having an oxidation potential that is different than the first oxidation potential. The composite material has a microstructure comprising the matrix of the first metal; and the second particles and third particles dispersed within the matrix, the third particles comprising a network of third particles extending throughout the matrix, the lightweight, selectively degradable composite material having a density of about 3.5 g/cm$^3$ or less.

BRIEF DESCRIPTION OF THE DRAWINGS

Referring now to the drawings wherein like elements are numbered alike in the several Figures.

DETAILED DESCRIPTION

Figure 1A:
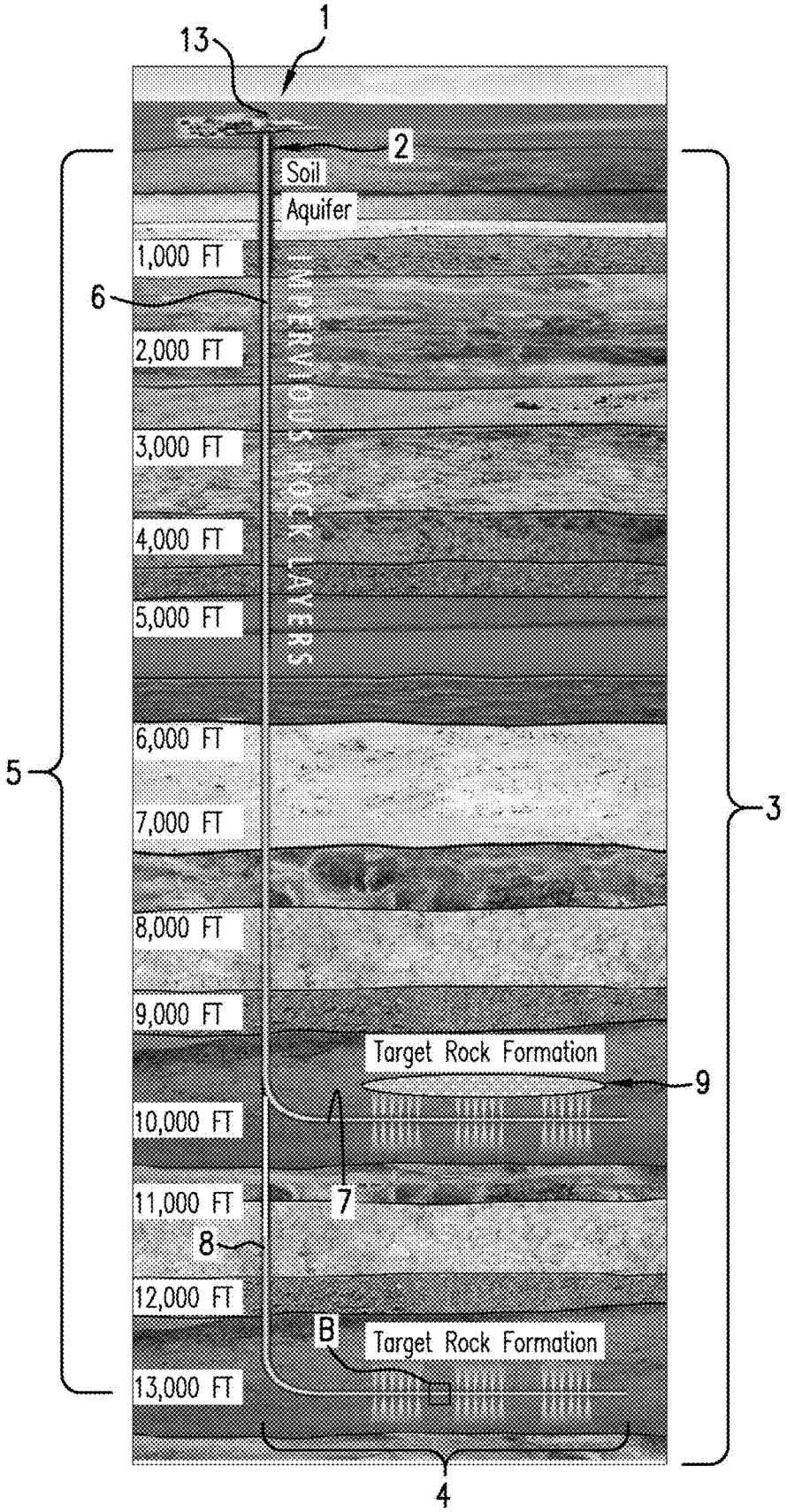
FIG. 1A is a schematic cross-section of an embodiment of a well including vertical and horizontal portions configured for use of selectively degradable articles of the lightweight, high strength, degradable composite material disclosed herein.
Figure 1B:
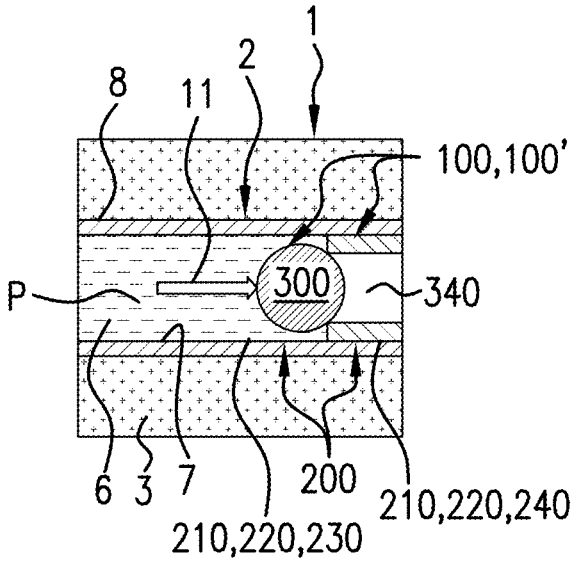
FIG. 1B is an enlarged portion B of the well of FIG. 1A illustrating an embodiment of a degradable ball and an embodiment of a degradable seat, such as a ball seat, formed of the lightweight, high strength, degradable composite material disclosed herein.
Figure 1C:
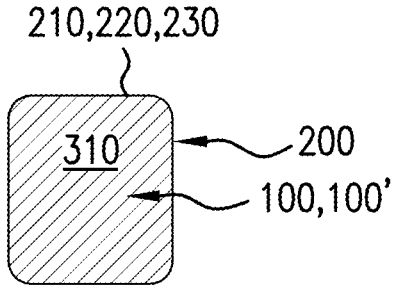
FIG. 1C is a schematic cross-section of an embodiment of a degradable plug formed of the lightweight, high strength, degradable composite material disclosed herein.
Figure 1D:
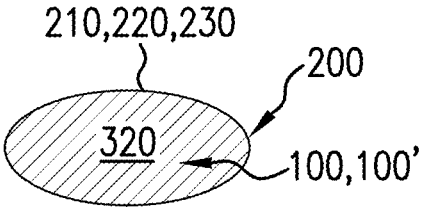
FIG. 1D is a schematic cross-section of an embodiment of a degradable disk formed of the lightweight, high strength, degradable composite material disclosed herein.
Figure 1E:
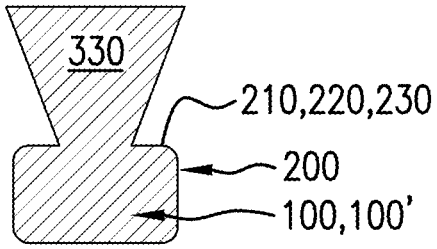
FIG. 1E is a schematic cross-section of an embodiment of a degradable dart formed of the lightweight, high strength, degradable composite material disclosed herein.

Referring to the figures, and particularly FIGS. 1B-3A, a lightweight, high strength, flowable, selectively degradable composite material 100, 100' is disclosed. The selectively degradable composite material 100, 100' has a high strength, such as an Ultimate Compressive Strength (UCS) of at least about 80 ksi, and in certain embodiments an even higher strength, including a UCS of at least about 100 ksi. Advantageously, the selectively degradable composite materials 100 described herein have a high strength comparable to that of Fe-base removable materials, as described herein, and a lower density. As a further advantage, the selectively degradable composite materials 100, 100' are lightweight, including having a selectively controllable density of about 1.5 to about 3.5 g/cm$^3$, and more particularly about 2.0 to about 3.5 g/cm$^3$, and even more particularly about 2.0 to about 3.0 g/cm$^3$. The selectively controllable density described herein enables selection of a density of the composite material 100, 100', as well as articles that include or are formed from the composite material, which allows the material or article to be flowable with the wellbore, particularly within horizontal portions of the wellbore 2 (FIGS. 1A and 1B). FIGS. 1A and 1B illustrate a well 1 and wellbore 2 that includes horizontal portions 4 and vertical portions 5. One problem associated with operations in the horizontal portions 4 of the wellbore 2 is that tools 230 and components 240 that are to be run in with a particular wellbore fluid 6 often have a density that is greater than the density of the wellbore fluid 6, such that they have a tendency to settle out of the flow 11 of the wellbore fluid 6 against the downwardmost portion 7 of the wellbore (e.g. the lowest portion of the inner diameter of the well casing 8 in a cased well 1), which tendency requires accommodation in the material/article design as well as the design of the processes and operations for which they are used, such as the use of higher wellbore fluid 6 working pressures P and flow 11 rates, for example. The composite materials disclosed herein are very advantageous and enable a method of using degradable downhole articles 220 that is particularly advantageous because it enables run in of these articles under conditions where the tendency of the article to settle, particularly in horizontal portion 4 is greatly reduced or eliminated by using downhole articles, including downhole tools 230 and components 240, having a density that is close to or even substantially equal to, including equal to, the density of the wellbore fluid 6 used to run it in, such that the buoyancy characteristics and buoyant forces on the articles described herein may be achieved. The wellbore fluids 6 may be any suitable wellbore fluids 6, including naturally occurring formation fluids 9, such as those that are extracted from or may be accessed from the earth formation 3 in which the well 1 is placed, and wellbore fluids 6 of any type that are introduced into the wellbore 2 from the surface, such as various drilling, completion and production wellbore fluids 6, or combinations of formation fluids 9 and surface wellbore fluids 13. This may include any number of ionic fluids and/or highly polar fluids, such as those that contain various chlorides, including all manner of fresh or salt water, brines and oil bearing fluids. Examples include potassium chloride (KCl), hydrochloric acid (HCl), calcium chloride ($CaCl_2$), calcium bromide ($CaBr_2$), or zinc bromide ($ZnBr_2$), or combinations thereof. The wellbore fluids 6 may be composite fluids that include solids dispersed or suspended or gelled in any manner within the fluid, such as formation materials, sand, proppants and the like, for example. These fluids, or composite fluids, may have a density of about 1.0 to about 3.5 g/cm$^3$, and more particularly about 1.5 to about 3.5 g/cm$^3$, and even more particularly about 2.0 to about 3.5 g/cm$^3$, and even more particularly about 2.0 to about 3.0 g/cm$^3$. The selectively controllable density of the selectively degradable composite material 100, 100' allows the material, and articles 200 made from the material, to have a density that is selected in conjunction with the selection of the wellbore fluid 6 being used, or vice versa, to provide a selectable buoyancy of the material and/or article that reduces, or in some embodiments eliminates, its tendency to settle in the wellbore fluid 6. For example, in certain embodiments the selectively controllable density of the composite material 100, 100' and/or article 200 may be selected to provide positive, neutral, or negative buoyancy, and more particularly may be selected to provide a buoyancy that is just slightly negative or slightly positive, such that the material and/or article has a tendency to slowly sink or slowly rise in the fluid, respectively, in a particular or predetermined wellbore fluid 6. For example, the density of the selectively degradable composite material and the wellbore fluid 6 may be selected to be the same to provide neutral buoyancy. In another example, the density of the selectively degradable composite material and the wellbore fluid 6 may be selected to be slightly positive or negative buoyancy by establishing a predetermined positive or negative buoyancy force differential of the material and/or article in the wellbore fluid 6, where the wellbore fluid may have any suitable density, including a density of about 1 to about 2.5 g/cc. Thus, the present invention is very advantageous by reducing the fluid pressures P or flow 11 rate needed to run in the composite material 100, 100' and/or downhole articles 220 made from the composite material into the wellbore 2, particularly horizontal portions 4 of the wellbore, while offering the flexibility of selective degradation and removal from the wellbore once its intended function has been performed. As an example, a ball 300, or similarly a plug 310 (FIG. 1C), disk 320 (FIG. 1D), dart 330 (FIG. 1E) or other downhole article 220 of the degradable composite material 100 can be run in to the wellbore 2, particularly horizontal portions 4 of the wellbore, in a selected or predetermined wellbore fluid 6 where the article and fluid are selected to provide predetermined buoyancy force differential and reduce the run in fluid pressure P and/or flow 11 requirements, such as, for example, reducing a fluid pressure differential required to move a moveable article (e.g. a ball, plug or dart in the wellbore fluid and/or reduce an impact force when landing in or on a horizontal leg. The article can be sealably seated against a degradable seat 340 formed from the degradable composite material 100 to perform a wellbore operation, such as a fracking operation as shown in FIG. 1A, and can then be selectively degraded, including selective removal, by a subsequent wellbore operation such as an acidizing operation, for example.

Figure 2A:
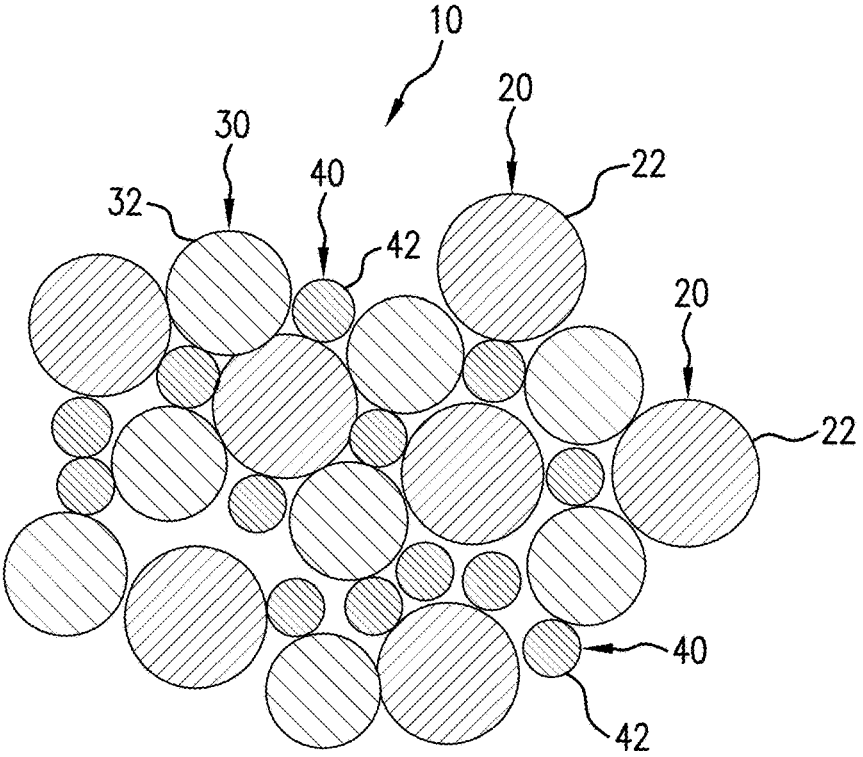
FIG. 2A is a schematic illustration of an exemplary embodiment of a powder mixture 10 comprising first powder 20, second powder 30 and third powder 40.
Figure 2B:
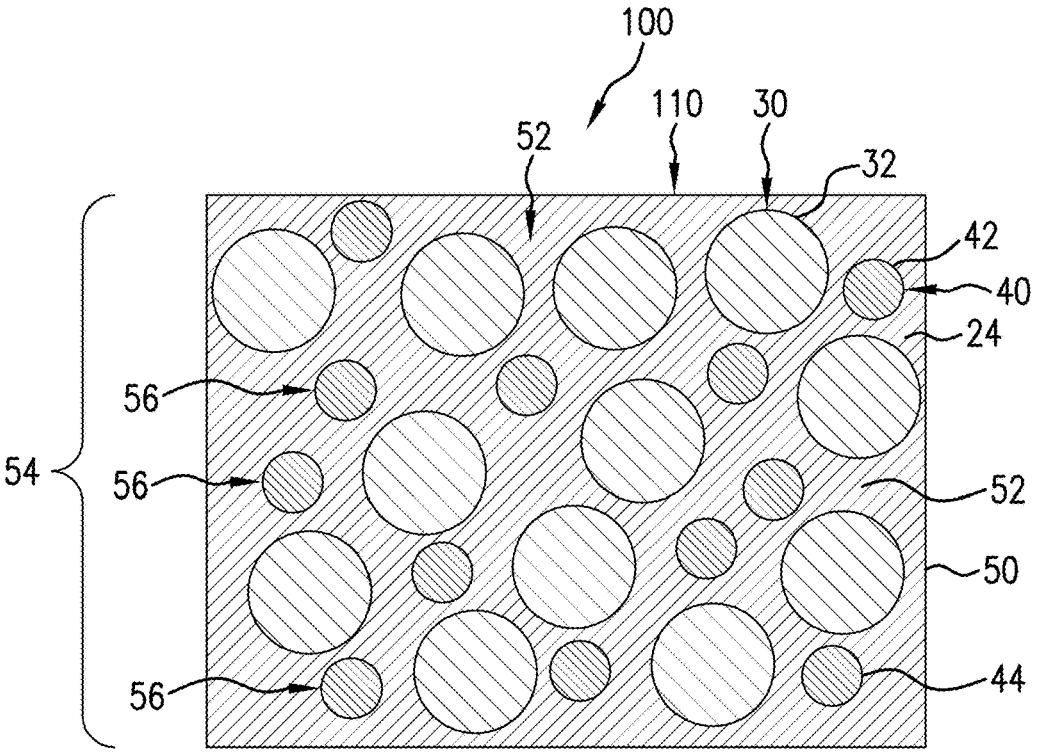
FIG. 2B is a schematic illustration of an exemplary embodiment of a composite material 100 comprising a powder compact 110 of powder mixture 10 of FIG. 2A.

In one embodiment, as illustrated in FIGS. 2A and 2B, the lightweight, selectively degradable composite material 100 includes a powder compact 110 (FIG. 2B) of powder mixture 10 (FIG. 2A) of a first powder 20, a second powder 30, and a third powder 40. The first powder 20 comprises first metal particles 22 comprising Mg, Al, Mn, or Zn, or an alloy of any of the above, or a combination of any of the above, having a first particle oxidation potential 24. The second powder 30 comprises low-density, lightweight, high strength ceramic, glass, cermet, intermetallic, metal, polymer, or inorganic compound second particles 32. The third powder 40 comprises third metal particles 42 having a third particle oxidation potential 44. The third particle oxidation potential 44 is different than the first particle oxidation potential 24. The compacted powder mixture 10 has a microstructure 50 comprising: a matrix 52 comprising the deformed and compacted first metal particles 22; the second particles 32 and third metal particles 42 dispersed within the matrix 52 as dispersed particles 54; and a network 56 comprising the third metal particles 42 extending throughout the matrix 52. The network 56 may include a continuous network of interconnected adjoining third metal particles 42 that are joined or bonded by the compaction and associated deformation and extends throughout the matrix 52 or a discontinuous network where adjoining third metal particles 42 are not joined or bonded to one another by the compaction and associated deformation used to form the powder compact 110. The lightweight, selectively degradable composite material 100 has a density of about 3.5 g/cm$^3$ or less, as described herein. This microstructure 50 is very advantageous because the network 56 of the third metal particles 42 that extends throughout and is metallurgically bonded within and to the matrix 52 of the first metal particles 22 provides an oxidation potential difference between these materials that extends throughout the composite material. The oxidation potential difference between the third metal particles 42 and the matrix 52 of the compacted and metallurgically bonded first metal particles 22 provides for rapid degradation and removal of the composite material 100, such as, for example, rapid dissolution or corrosion of the more anodic material in a predetermined wellbore fluid 6. The rapid degradation and removal of the composite material 100 may also be enhanced by other predetermined wellbore conditions, including selection of a predetermined wellbore temperature and/or a predetermined wellbore pressure that triggers or enhances or accelerates the degradation. This invention discloses a new lightweight, selectively degradable composite material 100 and method of making and use. This lightweight, selectively degradable composite material 100 encompasses high strength (e.g. a UCS of at least about 80 ksi, and in some embodiments at least about 100 ksi) and a controlled degradation, or dissolution, and/or disintegration rate while maintaining a low density (e.g. about 1.5 to about 3.5 g/cm$^3$). Low density is achieved by introducing high strength, light weight, nano- or micro-size, solid or hollow particles in the system. The ultrahigh strength characteristic provides the high pressure rating of the downhole tools 230 or components 240 and the lightweight characteristic guarantees the buoyancy of the tools in a wellbore fluid 6, both of which are imperative for downhole applications, particularly horizontal downhole applications, such as flow control devices including frac balls 300, darts 340, disks 330 or plugs 320 and associated sealing seats 340, for example.

In certain embodiments of the composite material 100, particularly where the powder mixture 10 comprises relatively smaller amounts, smaller sizes, or both of first metal particles 22, or relatively larger amounts, larger sizes, or both of third metal particles 42, or a combination thereof, the network 56 may be a continuous network where a number of adjacent third metal particles 42 are in touching contact or joined to one another throughout the microstructure 50 of the powder compact 100. In certain other embodiments, particularly where the powder mixture 10 comprises relatively larger amounts, larger sizes, or both of first metal particles 22 the network 56 may be a partially continuous network where a number of adjacent third metal particles 42 are joined to one another beyond immediately adjacent particles, such that the continuity extends beyond immediately adjacent third metal particles 42 to establish a partially continuous network of third metal particles that may extend 50 or more particle diameters, and more particularly 100 or more particle diameters, and even more particularly 1000 or more particle diameters of third metal particles 42. This may be measured, for example, by measuring the path length of touching or joined third metal particles 42 in a metallographic section, for example. Depending on the extent of the continuity, the partially continuous network 56 may also be described as locally continuous. For example, if the partial continuity of the network 56 extends only to metal coating layers 40 of immediately adjacent first metal particles 22, or to a small cluster of immediately adjacent first metal particles 22, the network 56 of metal coating layers may be said to be locally continuous, such as for example, if the network 56 of metal coating layers extends about 2 to less than about 50 particle diameters, and more particularly about 2 to about 30 particle diameters, and even more particularly about 2 to about 10 particle diameters of third metal particles 42. Local continuity of network 56 may be affected, for example, where the first metal particles 22 includes a mixture of coated first metal particles 22 that include metal coating layer 40 and uncoated first metal particles 22. In other embodiments, the network 56 may be substantially discontinuous, including discontinuous, where continuity of the third metal particles 42 does not extend substantially beyond or beyond, respectively, immediately adjacent third metal particles 42, such that the third metal particles 42 are isolated and not in touching contact or metallurgically bonded or joined to one another. In this embodiment, the first metal particles 22, second particles 32, and third metal particles 42 may be present in any suitable amounts. In one embodiment, the first metal particles include about 10 to about 50 percent, and the second particles 32 include about 50 to about 90 percent, and the third metal particles 42 may comprise about 0.5 to about 5 percent, by weight of the composite material 100, and in another embodiment the first metal particles include about 15 to about 50 percent, and the second particles 32 include about 50 to about 85 percent, and the third metal particles 42 comprise about 0.5 to about 10 percent, by weight of the composite material 100. The lightweight, selectively degradable composite material 100 has a density of about 3.5 g/cm$^3$ or less, as described herein.

Figure 3A:
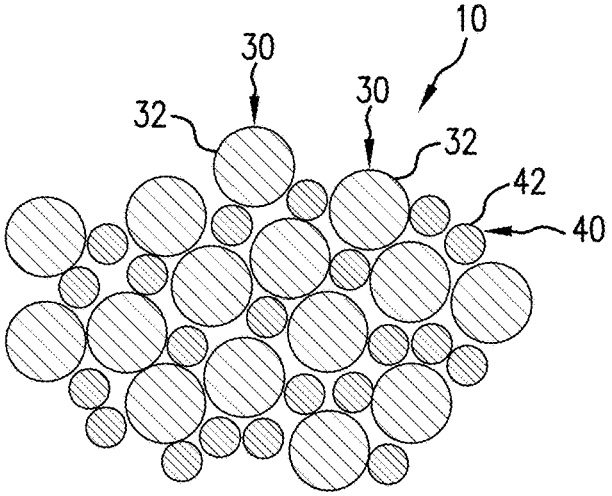
FIG. 3A is a schematic illustration of a second exemplary embodiment of a powder mixture 10' comprising second powder 30 and third powder 40.
Figure 3B:
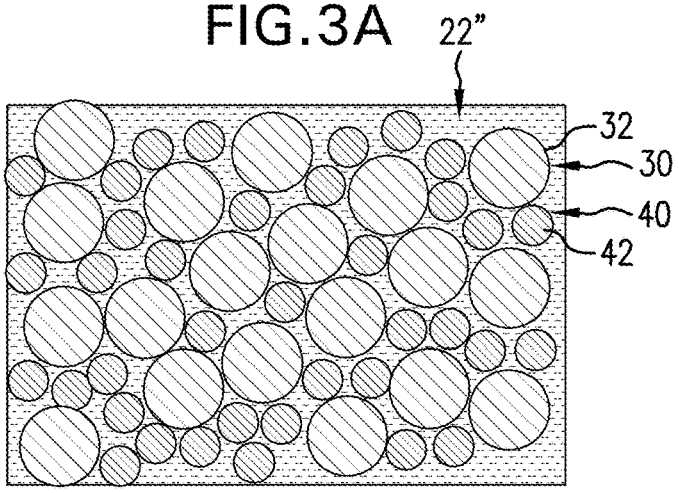
FIG. 3B is a schematic illustration of an exemplary embodiment of a composite material 100' comprising a melt-infiltrated powder mixture 10' of FIG. 3A.
Figure 3C:
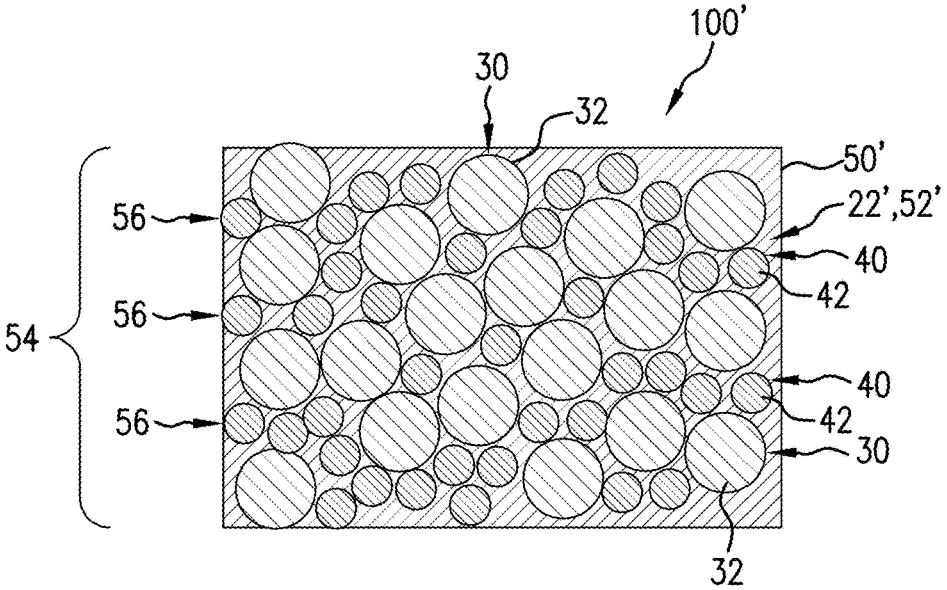
FIG. 3C is a schematic illustration of an exemplary embodiment of a composite material 100' comprising a melt-infiltrated and solidified powder mixture 10' of FIG. 3A.

In another embodiment, as illustrated in FIGS. 3A, 3B, and 3C the lightweight, selectively degradable composite material 100' includes a matrix 52' of a first metal 22' with a second powder 30 and a third powder 40 dispersed throughout the matrix. The matrix 52' comprises a first metal 22' comprising Mg, Al, Mn, or Zn, or an alloy of any of the above, or a combination of any of the above, having a first metal oxidation potential 24'. The second powder 30 comprises low-density, lightweight, high strength ceramic, glass, cermet, intermetallic, metal, polymer, or inorganic compound second particles 32. The third powder 40 comprises third metal particles 42 having a third particle oxidation potential 44. The third particle oxidation potential 44 is different than the first metal oxidation potential 24'. The lightweight, selectively degradable composite material 100' has a microstructure 50' comprising the matrix 52' comprising an as-cast microstructure of the first metal 22' with the second particles 32 and third metal particles 42 dispersed within the matrix 52' as dispersed particles 54; and a network 56 comprising the third metal particles 42 extending throughout the matrix 52. The matrix 52' may be formed, for example, by infiltrating a compacted or uncompacted mixture of the second particles 32 and third metal particles 42 (FIG. 3A) with molten first metal 22' (FIG. 3B) followed by solidification of the molten metal (FIG. 3C). The network 56 may include a continuous network of interconnected adjoining third metal particles 42 that are in touching contact or metallurgically joined or bonded to one another by the infiltration and extends throughout the matrix 52 or a discontinuous network where adjoining third metal particles 42 are not in touching contact with one another or joined or bonded to one another by or during the infiltration used to form the composite material 100'. The lightweight, selectively degradable composite material 100' also has a density of about 3.5 g/cm$^3$ or less, as described herein concerning composite material 100. This microstructure 50' is also very advantageous because the network 56 of the third metal particles 42 that extends throughout and is metallurgically bonded within and to the matrix 52' of the first metal 22' provides an oxidation potential difference between these materials that extends throughout the composite material. The oxidation potential difference between the third metal particles 42 and the matrix 52' of the compacted and metallurgically bonded first metal 22' provides for rapid degradation and removal of the composite material 100', such as, for example, rapid dissolution or corrosion of the more anodic material in a predetermined wellbore fluid 6. The rapid degradation and removal of the composite material 100' may also be enhanced by other predetermined wellbore conditions, including selection of a predetermined wellbore temperature and/or a predetermined wellbore pressure that triggers or enhances or accelerates the degradation. This invention discloses a new lightweight, selectively degradable composite material 100' and method of making and use. This lightweight, selectively degradable composite material 100' encompasses high strength (e.g. a UCS of at least about 80 ksi, and in some embodiments at least about 100 ksi) and a controlled degradation, or dissolution, and/or disintegration rate while maintaining a low density (e.g about 1.5 to about 3.5 g/cm$^3$). Low density is achieved by introducing high strength, light weight, nano- or micro-size, solid or hollow particles in the system. The ultrahigh strength characteristic provides the high pressure rating of the downhole tools 230 or components 240 and the lightweight characteristic guarantees the buoyancy of the tools in a wellbore fluid 6, both of which are imperative for downhole applications, particularly horizontal downhole applications, such as flow control devices including frac balls 300, darts 340, disks 330 or plugs 320 and associated sealing seats 340, for example.

In certain embodiments of the composite material 100', particularly where the composite material comprises relatively smaller amounts of first metal 22', or relatively larger amounts, larger sizes, or both of third metal particles 42, or a combination thereof, the network 56 may be a continuous network where a number of adjacent third metal particles 42 are in touching contact or joined to one another throughout the microstructure 50 of the composite material 100'. In certain other embodiments, particularly where the composite material 100' comprises relatively larger amounts of first metal 22' the network 56 may be a partially continuous network where a number of adjacent third metal particles 42 are joined to one another beyond immediately adjacent particles, such that the continuity extends beyond immediately adjacent third metal particles 42 to establish a partially continuous network of third metal particles that may extend 50 or more particle diameters, and more particularly 100 or more particle diameters, and even more particularly 1000 or more particle diameters of third metal particles 42. This may be measured, for example, by measuring the path length of touching or joined third metal particles 42 in a metallographic section, for example. Depending on the extent of the continuity, the partially continuous network 56 may also be described as locally continuous. For example, if the partial continuity of the network 56 extends only to metal coating layers 40 of immediately adjacent first metal particles 22, or to a small cluster of immediately adjacent first metal particles 22, the network 56 of metal coating layers may be said to be locally continuous, such as for example, if the network 56 of metal coating layers extends about 2 to less than about 50 particle diameters, and more particularly about 2 to about 30 particle diameters, and even more particularly about 2 to about 10 particle diameters of third metal particles 42. Local continuity of network 56 may be affected, for example, where the first metal particles 22 includes a mixture of coated first metal particles 22 that include metal coating layer 40 and uncoated first metal particles 22. In other embodiments, the network 56 may be substantially discontinuous, including discontinuous, where continuity of the third metal particles 42 does not extend substantially beyond or beyond, respectively, immediately adjacent third metal particles 42, such that the third metal particles 42 are isolated and not in touching contact or metallurgically bonded or joined to one another. In this embodiment, the first metal particles 22, second particles 32, and third metal particles 42 may be present in any suitable amounts. In one embodiment, the first metal particles include about 10 to about 50 percent, and the second particles 32 include about 50 to about 90 percent, and the third metal particles 42 may comprise about 0.5 to about 5 percent, by weight of the composite material 100, and in another embodiment the first metal particles include about 15 to about 50 percent, and the second particles 32 include about 50 to about 85 percent, and the third metal particles 42 comprise about 0.5 to about 10 percent, by weight of the composite material 100. The lightweight, selectively degradable composite material 100 has a density of about 3.5 g/cm$^3$ or less, as described herein.

The microstructures 50, 50' of the selectively degradable composite materials 100, 100' are different from selectively degradable nanomatrix materials, such as those taught in US Patent Publication US2011/0132143A1, US2011/0135953A1, US2011/0135530A1, US2011/0136707A1, US2013/0047785A1, US2013/0052472A1, and US2013/0047784A1, which are incorporated herein by reference in their entirety, because they either does not have a substantially continuous cellular nanomatrix with dispersed metal particles, or because they include dispersed lightweight (i.e. low density) particles. Rather, in the embodiments of the present invention, the third metal particles 42 form a network 56, which may be continuous, partially continuous, locally continuous or discontinuous, or a combination thereof, as described herein.

The powder mixtures 10 of first powder 20, second powder 30, and third powder 40 described herein concerning composite material 100 and the powder mixtures 10' of second powder 30 and third powder 40 described herein concerning composite material 100' may be formed in any suitable manner, including all manner of mechanical mixing, including various powder mills and blenders. In one embodiment, the powder mixture 10, 10' comprises a substantially homogeneous mixture, and more particularly includes a homogeneous mixture, where the first powder 20 particles, second powder 30 particles, and third powder 40 particles, or second powder 30 particles and third powder 40 particles, respectively, are substantially uniformly dispersed or uniformly dispersed, respectively, within one another. As used herein, substantially homogeneous means that there is uniformity within substantial portions of the mixture, but that there may be isolated localized instances of non-uniformity within the mixture. In other embodiments, the powder mixture 10, 10' may be heterogeneous mixtures of first powder 20, second powder 30, and third powder 40, or second powder 30 and third powder 40, respectively, including gradient mixtures of these particles analogous to the particle mixtures used to form functionally gradient articles as described in US Patent Publication US20120276356A1, which is incorporated herein by reference in its entirety.

The first metal particles 22, or first metal 22', may include Mg, Al, Mn, or Zn, or an alloy of any of the above, or a combination of any of the above. The first metal particles 22 may have any suitable size or shape. In one embodiment, the first metal particles 22 have an average size of about 5 to about 300 μm, and more particularly an average size of about 75 to about 150 μm. In one embodiment, the first metal particles 22, or first metal 22', comprise a magnesium-base alloy. The magnesium-base alloy may include any suitable magnesium-base alloy, including an Mg—Si, Mg—Al, Mg—Zn, Mg—Mn, Mg—Al—Zn, Mg—Al—Mn, Mg—Zn—Zr, or Mg—X alloy, where X comprises a rare earth element, or an alloy of thereof, or any other combination of the aforementioned alloys. As used herein, rare earth elements include Sc, Y, La, Ce, Pr, Nd, or Er, or a combination of rare earth elements.

The second particles 32 may include any suitable low density particle. In one embodiment the second particles 32 include low-density ceramic, glass, cermet, intermetallic, metal, polymer, or inorganic compound second particles 32. The second particles 32 may have any suitable size or shape. In one embodiment, the second particles 32 have a density of about 0.1 to about 4.5 g/cm$^3$. The metal particles may include any suitable metal particles, including hollow or porous metal particles. In one embodiment, the metal particles may include pure titanium particles. In another embodiment the metal particles may include titanium alloy particles, including titanium-base alloy particles. Titanium alloy particles may include particles of any suitable commercially available titanium alloy or grade (e.g. Grades 1-38), including, for example, Ti-6A1-4V, which has a nominal composition comprising, by weight: about 6 percent aluminum, about 4 percent vanadium, and the balance titanium and incidental impurities. In another embodiment, the metal particles include hollow metal particles, particularly hollow iron alloy particles, and more particularly hollow iron-base alloy particles, and even more particularly hollow steel particles. In one embodiment, the metal particles may have an average particle size of about 10 to about 200 μm. The use of metal particles as second particles 32 is highly advantageous because while providing low density, lightweight powder compacts 100 as described herein, the powder compact materials 110 made using metal particles as second particles 32 are also capable of being rapidly formed to a near-net shape, such as by dynamic forging, which is highly desirable. In addition, powder compact materials 110 made using metal particles as second particles 32 are metallic materials and are also readily formable and/or machinable using any of a number of commercial metal working and finishing processes to a final or net shape. They may, for example, be finished to precise tolerances and surface finishes, which is useful in the manufacture of articles from these materials that require mating seating and/or sealing surfaces, such as balls, plugs, darts and the like that have mating seating and/or sealing surfaces. In addition to being lightweight and high strength, as described herein, the powder compact materials 110 made using metal particles as second particles 32 are also capable of providing relatively higher ductility and fracture toughness. In another embodiment, the second particles 32 include ceramic, glass, polymer, or inorganic compound particles, including hollow or porous particles of these materials. In another embodiment, the second particles 32 include ceramic particles comprising metal carbide, nitride, or oxide particles, or a combination thereof. One embodiment of ceramic particles includes silicon carbide particles, and more particularly silicon carbide particles that have an average particle diameter of about 5 to about 200 μm. In one embodiment, the second particles 32 may have a substantially spherical particle shape. In another embodiment, the second particles 32 may comprise substantially non-spherical particles, including irregularly shaped particles, having rounded edges.

The third metal particles 42 may be any suitable metal that is configured to provide a potential difference with the matrix 50 of first metal particles 22, or matrix 50' of first metal 22', as described herein. In one embodiment, the third metal particles 42 include Al, Ni, Fe, Cu, In, Ga, Mn, Zn, Mg, Mo, Ca, Co, Ta, W, Si, or Re, or an alloy thereof, or any combination thereof. In other embodiments, the third metal particles 42 may include a mixture of different metal particles that include Al, Ni, Fe, Cu, In, Ga, Mn, Zn, Mg, Mo, Ca, Co, Ta, W, Si, or Re, or an alloy thereof, or any combination thereof. In one embodiment, where the first metal particles 22, or first metal 22', include a magnesium-base alloy, the third metal particles includes Ni, Fe, Cu, or Co, or an alloy thereof, or any combination thereof. The third metal particles may have any suitable size, and in one embodiment have an average size of about 0.1 to about 100 μm, and more particularly an average size of about 1 to about 10 μm.

The difference in the oxidation potential between the first metal particles 22, or first metal 22', and the third metal particles 42 may be any suitable oxidation potential difference, including a predetermined difference, and may be selected to provide a predetermined or selected dissolution or corrosion rate of the lightweight, high strength selectively degradable composite materials 100, 100'. This may include the differences in the chemical compositions and oxidation potential difference may be configured to provide a selectable and controllable dissolution rate, including a selectable transition from a very low dissolution rate to a very rapid dissolution rate, in response to a controlled change in a property or condition of the wellbore proximate the composite material 100, 100' including a property change in a wellbore fluid 6 that is in contact with the material, as described herein. In one embodiment, the first particle oxidation potential is about 0.7 volts or more, and the coating oxidation potential is about 0.5 volts or less. In other embodiments, a difference between the first particle oxidation potential and the coating oxidation potential is about 0.7 to about 2.7 volts.

The composite materials 100, 100' disclosed herein may be configured, including a difference between the first particle (or first metal) oxidation potential and the third particle oxidation potential 44 as described herein, to be selectively and controllably disposable, degradable, dissolvable, corrodible, or otherwise removable from a wellbore using a predetermined wellbore fluid 6, including those described herein. These materials may, for example, be configured to be selectably dissolvable at a rate that ranges from about 0 to about 7000 mg/cm$^2$/hr depending on the powder compact material 110 and wellbore fluid 6 selected. For example, the composite material 100, 100' may be selected to have a temperature dependent corrosion rate in a given wellbore fluid 6, such as a relatively low rate of corrosion in a 3% KCl solution at room temperature that ranges from about 0 to about 10 mg/cm$^2$/hr as compared to relatively high rates of corrosion at 200° F. in the same solution that range from about 1 to about 250 mg/cm$^2$/hr depending on the composite material 100, 100' selected. An example of a changed condition comprising a change in chemical composition includes a change in a chloride ion concentration or pH value, or both, of the wellbore fluid 6. For example, various composite materials 100, 100' described herein may have corrosion rates in 15% HCl that range from about 4,500 mg/cm$^2$/hr to about 7,500 mg/cm$^2$/hr. Thus, selectable and controllable dissolvability in response to a changed condition in the wellbore, namely the change in the wellbore fluid 6 chemical composition from KCl to HCl, may be achieved.

The lightweight, high strength, selectively degradable composite material 100, 100' may be formed into any article 200 by any suitable metalworking or forming methods. Composite material 100, 100' may have any desired shape or size, including that of a cylindrical billet, bar, sheet or other form that may be machined, formed or otherwise used to form useful articles of manufacture, including various wellbore tools and components. Pressing may be used to form a precursor powder compact 120 and sintering and pressing processes may be used to form powder compact 110 and deform the first metal powder particles 22, second particles, and third metal particles 42 to provide the full density and desired macroscopic shape and size of powder compact 110 as well as its microstructure 50, for example. The morphology (e.g. equiaxed or substantially elongated) of the deformed the first metal powder particles 22, second particles 32, and third metal particles 42 results from sintering and deformation of these powder particles as they are compacted and interdiffuse and deform to fill the interparticle spaces. The sintering temperatures and pressures may be selected to ensure that the density of composite material 100 achieves substantially full theoretical density.

In one exemplary embodiment, the powder compact 110 microstructure 50 is formed at a sintering temperature ($T_S$), where $T_S$ is less than the melting temperature of the first metal particle 22 ($T_{P1}$), second particle 32 ($T_{P2}$), and third metal particle 42 ($T_{P3}$). A solid-state metallurgical bond is formed in the solid state by solid-state interdiffusion the first metal particles 22, second particles, or third metal particles 42, or any combination thereof, that are compressed into touching contact during the compaction and sintering processes used to form composite material 100, as described herein.

As the network 56 of third metal particles 42 is formed, including the metallurgical bonds and bond layers between them, the chemical composition or phase distribution, or both, of third metal particles 42 may change. Network 56 also has a melting temperature ($T_M$). As used herein, $T_M$ includes the lowest temperature at which incipient melting or liquation or other forms of partial melting will occur within network 56, regardless of whether the third metal particle 42 comprises a pure metal, an alloy with multiple phases each having different melting temperatures or a composite, including a composite comprising a plurality of materials having different melting temperatures, or a combination thereof, or otherwise. As the matrix 52 is formed in conjunction with network 56, diffusion of constituents of third metal particles 42 into the first metal particles 22, or first metal 22', and/or second particles 32 is also possible, which may result in changes in the chemical composition or phase distribution, or both, of first metal particles 22, or first metal 22', and/or second particles 32. As a result, matrix 52, 52' and network 56 may have a melting temperature their constituent materials. In one embodiment, powder compact 110 is formed at a sintering temperature ($T_S$), where sintering is performed entirely in the solid-state. In another exemplary embodiment, powder compact material 110 is formed at a sintering temperature ($T_S$), where $T_S$ is greater than or equal to one or more of $T_C$, $T_P$, $T_M$ or $T_{DP}$ and the sintering includes limited or partial melting within the powder compact material 110 as described herein, and further may include liquid-state or liquid-phase sintering resulting in a bond layer that is at least partially melted and resolidified. In this embodiment, the combination of a predetermined $T_S$ and a predetermined sintering time ($t_S$) will be selected to preserve the desired microstructure 50 as described herein. For example, localized liquation or melting may be permitted to occur, for example, within all or a portion of network 56 so long as the network and matrix 52 structure and morphology is preserved, such as by selecting first metal particles 22, $T_S$ and $t_S$ that do not provide for complete melting of the first metal particles 22. Similarly, localized liquation may be permitted to occur, for example, within all or a portion of matrix 52 so long as the microstructure 50 morphology is preserved, such as by selecting metal coating layers 40, $T_S$ and $t_S$ that do not provide for complete melting of the coating layer or layers 40. Melting of metal coating layers 40 may, for example, occur during sintering along the metal coating layer 40/first metal particle 22 interface, or along the interface between adjacent layers of multi-layer metal coating layers 40. It will be appreciated that combinations of $T_S$ and $t_S$ that exceed the predetermined values may result in other microstructures 50, such as an equilibrium melt/resolidification microstructure 50 if, for example, both the network 56 (i.e., third metal particles 42) and matrix 52 (i.e., the first metal particles 22) are melted, thereby allowing rapid interdiffusion of these materials.

In another exemplary embodiment, the composite material 100' microstructure 50 is formed by melt infiltration at an infiltration temperature ($T_I$), where $T_I$ is greater than the melting temperature of the first metal 22' ($T_{M1}$), but less than the melting temperature of second particle 32 ($T_{P2}$), and third metal particle 42 ($T_{P3}$). A metallurgical bond is formed by interdiffusion of the liquid first metal 22' and the solid second particles 32 and third metal particles 42 upon infiltration of the molten first metal 22', and its subsequent solidification used to form composite material 100', as described herein.

In one embodiment, the powder compact 110 composite material 100 is formed by a method that includes selecting the first metal particles 22, second particles 32, and third metal particles 42. The method also includes mixing the first metal particles 22, second particles 32, and third metal particles 42 to form the powder mixture 10. Mixing may be performed to provide a homogeneous mixture 10 or a non-homogeneous or heterogeneous mixture as described herein. Mixing to provide a homogeneous powder mixture may be performed in any suitable mixing apparatus, including Attritor mixers, drum mixers, ball mills, blenders, including conical blenders, and the like, and by any suitable mixing method. In one embodiment, mixing was performed in an Attritor mixer having a central vertical shaft and one or more blending arms disposed thereon, such as a plurality of lateral extending axially and vertically spaced arms or a laterally and axially disposed helical arm. The Attritor mixer may be water cooled and the mixing chamber may be purged with an inert gas during mixing. The powders are disposed therein together with a milling medium, such as ceramic or stainless steel beads having a diameter of about 6 to about 10 mm. The shaft or mixing chamber is rotated for a predetermined mixing interval to mix or blend the powders and form the desired powder mixture 10. The mixing interval may be any suitable period, and in one embodiment may be about 10 to about 90 minutes, and more particularly about 30 to about 60 minutes. The method also includes forming the powder compact 110 with microstructure 50 from the powder mixture 10. The microstructure 50 formed of the network 56 of third metal particles 42, matrix 52 and dispersed particles 54 is formed by the compaction and sintering of the first metal particles 22, second particles 32, and third metal particles 42, such as by CIP, HIP or dynamic forging. In one embodiment, the powder mixture 10 may be compacted without sintering such that the microstructure comprises mechanical bonds between first metal particles 22, second particles 32, and third metal particles 42 formed by deformation during compaction. The chemical composition of the network 56 may be different than that of the third metal particles 42 due to diffusion effects associated with sintering. Powder metal compact 110 also includes matrix 52 that comprises first metal particles 22. Network 56 and matrix 52 correspond to and are formed from the plurality of third metal particles 42 and first metal particles 22, respectively, as they are sintered together. The chemical composition of matrix 52 may also be different than that of first metal particles 22 due to diffusion effects associated with sintering. The method may also include forming an article 200 from the powder compact 110 by any suitable forming method.

In another embodiment, the composite material 100' is formed by a method that includes selecting the first metal 22', second particles 32, and third metal particles 42. The method also includes mixing the second particles 32 and third metal particles 42 to form the powder mixture 10'. Mixing may be performed to provide a homogeneous mixture 10' or a non-homogeneous or heterogeneous mixture as described herein. Mixing to provide a homogeneous powder mixture may be performed in any suitable mixing apparatus and by any suitable mixing method, including those described above. The method also includes forming the composite material 100' with microstructure 50' from the powder mixture 10'. The microstructure 50' formed of the network 56 of third metal particles 42, matrix 52' and dispersed particles 54 is formed by infiltration of the molten first metal 22' into the powder mixture 10', compacted or uncompacted, of the second particles 32 and third metal particles 42. The chemical composition of the network 56 may be different than that of the third metal particles 42 due to diffusion effects associated with sintering. Composite material 100' includes matrix 52' that comprises as-cast first metal 22'. Network 56 and matrix 52 correspond to and are formed from the plurality of third metal particles 42 and first metal 22', respectively, upon solidification of the molten first metal 22". The chemical composition of matrix 52 may also be different than that of first metal 22' due to diffusion effects associated with infiltration of the molten metal and solidification. The method may also include forming an article 200 from the composite material 100' by any suitable forming or metal working method.

In one embodiment, the article 200 includes a selectively degradable article 210. In another embodiment, the article 200 includes a selectively degradable downhole article 220. In yet another embodiment, the selectively degradable downhole article 220 comprises a selectively degradable flow inhibition tool 230 or component 240. In still further embodiments, the selectively degradable flow inhibition tool 230 or component 240 comprises a frac plug, bridge plug, wiper plug, shear out plug, debris barrier, atmospheric chamber disc, swabbing element protector, sealbore protector, screen protector, beaded screen protector, screen basepipe plug, drill in stim liner plug, inflow control device plug, flapper valve, gaslift valve, transmatic plug, float shoe, dart, diverter ball, shifting/setting ball, ball seat, plug seat, dart seat, sleeve, teleperf disk, direct connect disk, drill-in liner disk, fluid loss control flapper, shear pin, screw, bolt, or cement plug.

The terms "a" and "an" herein do not denote a limitation of quantity, but rather denote the presence of at least one of the referenced items. The modifier "about" used in connection with a quantity is inclusive of the stated value and has the meaning dictated by the context (e.g., includes the degree of error associated with measurement of the particular quantity). Furthermore, unless otherwise limited all ranges disclosed herein are inclusive and combinable (e.g., ranges of "up to about 25 weight percent (wt. %), more particularly about 5 wt. % to about 20 wt. % and even more particularly about 10 wt. % to about 15 wt. %" are inclusive of the endpoints and all intermediate values of the ranges, e.g., "about 5 wt. % to about 25 wt. %, about 5 wt. % to about 15 wt. %", etc.). The use of "about" in conjunction with a listing of constituents of an alloy composition is applied to all of the listed constituents, and in conjunction with a range to both endpoints of the range. Finally, unless defined otherwise, technical and scientific terms used herein have the same meaning as is commonly understood by one of skill in the art to which this invention belongs. The suffix "(s)" as used herein is intended to include both the singular and the plural of the term that it modifies, thereby including one or more of that term (e.g., the metal(s) includes one or more metals). Reference throughout the specification to "one embodiment", "another embodiment", "an embodiment", and so forth, means that a particular element (e.g., feature, structure, and/or characteristic) described in connection with the embodiment is included in at least one embodiment described herein, and may or may not be present in other embodiments.

It is to be understood that the use of "comprising" in conjunction with the alloy compositions described herein specifically discloses and includes the embodiments wherein the alloy compositions "consist essentially of" the named components (i.e., contain the named components and no other components that significantly adversely affect the basic and novel features disclosed), and embodiments wherein the alloy compositions "consist of" the named components (i.e., contain only the named components except for contaminants which are naturally and inevitably present in each of the named components).

While one or more embodiments have been shown and described, modifications and substitutions may be made thereto without departing from the spirit and scope of the invention. Accordingly, it is to be understood that the present invention has been described by way of illustrations and not limitation.

The invention claimed is:

1. A low density, selectively degradable composite material comprising a compacted powder mixture of a first powder, the first powder comprising first metal particles comprising Mg, Al, Mn, or Zn, or an alloy of any of the above, or a combination of any of the above, having a first particle oxidation potential, a second powder, the second powder comprising low-density, hollow or porous ceramic, cermet, intermetallic, metal, or polymer second particles, and a third metal powder, the third metal powder comprising third metal particles having an oxidation potential that is different than the first particle oxidation potential, the compacted powder mixture having a microstructure comprising:

a matrix comprising the first metal particles; and the second particles and third particles dispersed within the matrix, the third particles comprising a network of third particles extending throughout the matrix, the low density, selectively degradable composite material having a density of about 3.5 g/cm3 or less;

wherein the composite material comprises about 15 wt. % to about 50 wt. % of the first metal particles, about 50 wt. % to 85 wt. % of the second particles, and about 0.5 wt. % to about 10 wt. % of the third metal particles, each based on a weight of the composite material.

2. The composite material of claim 1, wherein the third particles are substantially homogeneously dispersed within the matrix, and the network is substantially discontinuous, wherein adjacent third particles are not in touching contact with one another.

3. The composite material of claim 1, wherein the third particles are substantially homogeneously dispersed within the matrix, and wherein the network is partially continuous and adjacent third particles are in touching contact with one another throughout at least a portion of the matrix.

4. The composite material of claim 1, wherein the third particles are substantially homogeneously dispersed within the matrix, and wherein the network is locally continuous and adjacent third particles are in touching contact with one another throughout a localized portion of the matrix.

5. The composite material of claim 1, wherein the third particles are substantially homogeneously dispersed within the matrix, and wherein the network is continuous and adjacent third particles are in touching contact with one another throughout the matrix.

6. The composite material of claim 1, wherein a portion of the third particles are in touching contact with adjacent third particles and comprise an interconnected network of third particles within the matrix.

7. The composite material of claim 1, wherein the first particle oxidation potential is about 0.7 volts or more, and the third particle oxidation potential is about 0.5 volts or less.

8. The composite material of claim 1, wherein a difference between the first particle oxidation potential and the third particle oxidation potential is about 0.7 to about 2.7 volts.

9. The composite material of claim 1, wherein the low density, selectively degradable composite material has a density of about 1.5 to about 3.5 g/cm3.

10. The composite material of claim 1, wherein the composite material has an ultimate compressive strength of at least 80 ksi.

11. The composite material of claim 1, wherein the composite material has an ultimate compressive strength of at least 100 ksi.

12. The composite material of claim 1, wherein the first metal particles have an average size of about 5 to about 300 μm.

13. The composite material of claim 1, wherein the first metal particles have an average size of about 75 to about 150 μm.

14. The composite material of claim 1, wherein the first metal particles comprise a magnesium-base alloy.

15. The composite material of claim 14, wherein the magnesium-base alloy comprises an Mg—Si, Mg—Al, Mg—Zn, Mg—Mn, Mg—Al—Zn, Mg—Al—Mn, Mg—Zn—Zr, or Mg—X alloy, where X comprises a rare earth element, or an alloy thereof, or any other combination of the aforementioned.

16. The composite material of claim 15, wherein the third metal particles comprise Ni, Fe, Cu, or Co, or an alloy thereof, or any combination thereof.

17. The composite material of claim 1, wherein the second particles have a density of about 0.1 to about 4.0 g/cm3.

18. The composite material of claim 1, wherein the metal second particles comprise hollow metal particles.

19. The composite material of claim 1, wherein the metal second particles comprise pure Ti or a Ti alloy.

20. The composite material of claim 1, wherein the metal second particles have an average particle size of about 10 to about 200 μm.

21. The composite material of claim 1, wherein the ceramic particles comprise metal carbide, nitride, or oxide particles, or a combination thereof.

22. The composite material of claim 1, wherein the ceramic particles comprise silicon carbide particles.

23. The composite material of claim 22, wherein the silicon carbide particles have an average particle size of about 5 to about 200 μm.

24. The composite material of claim 1, wherein the second particles comprise substantially spherical particles.

25. The composite material of claim 1, wherein the second particles comprise substantially non-spherical particles having rounded edges.

26. A selectively degradable article, comprising:

a low density, selectively degradable composite material, the composite material comprising a compacted powder mixture of a first powder, the first powder comprising first metal particles comprising Mg, Al, Mn, or Zn, or an alloy of any of the above, or a combination of any of the above, having a first particle oxidation potential, a second powder, the second powder comprising low-density, hollow or porous ceramic, cermet, intermetallic, metal, or polymer second particles, and a third metal powder, the third metal powder comprising third metal particles having an oxidation potential that is different than the first particle oxidation potential, the compacted powder mixture having a microstructure comprising:

a matrix comprising the first metal particles; and the second particles and third particles dispersed within the matrix, the third particles comprising a network of third particles extending throughout the matrix, the low density, selectively degradable composite material having a density of about 3.5 g/cm3 or less;

wherein the composite material comprises about 15 wt. % to about 50 wt. % of the first metal particles, about 50 wt. % to 85 wt. % of the second particles, and about 0.5 wt. % to about 10 wt. % of the third metal particles, each based on a weight of the composite material.

27. The article of claim 26, wherein the composite material comprises a selectively degradable downhole article.

28. The article of claim 27, wherein the selectively degradable downhole article comprises a selectively degradable flow inhibition tool or component.

29. The article of claim 28, wherein the selectively degradable flow inhibition tool or component is selected from the group consisting of a frac plug, bridge plug, wiper plug, shear out plug, debris barrier, atmospheric chamber disc, swabbing element protector, sealbore protector, screen protector, beaded screen protector, screen basepipe plug, drill in stim liner plug, inflow control device plug, flapper valve, gaslift valve, transmatic plugs, float shoe, dart, diverter ball, shifting/setting ball, ball seat, plug seat, dart seat, sleeve, teleperf disk, direct connect disk, drill-in liner disk, fluid loss control flapper, shear pin, screw, bolt, and cement plug.

30. The article of claim 29, wherein the article is used in a method comprising at least partially inhibiting a fluid flow in a wellbore.

31. A lightweight, selectively degradable composite material comprising a first matrix of a first metal comprising Mg, Al, Mn, or Zn, or an alloy of any of the above, or a combination of any of the above, having a first oxidation potential, a second powder, the second powder comprising low-density ceramic, glass, cermet, intermetallic, metal, polymer, or inorganic compound second particles, and a third metal powder, the third metal powder comprising third metal particles having an oxidation potential that is different than the first oxidation potential, the composite material having a microstructure comprising:

the matrix of the first metal; and the second particles and third particles dispersed within the matrix, the third particles comprising a network of third particles extending throughout the matrix, the lightweight, selectively degradable composite material having a density of about 3.5 g/cm3 or less.

32. The composite material of claim 31, wherein the third particles are substantially homogeneously dispersed within the matrix, and the network is substantially discontinuous, wherein adjacent third particles are not in touching contact with one another.

33. The composite material of claim 31, wherein the third particles are substantially homogeneously dispersed within the matrix, and wherein the network is partially continuous and adjacent third particles are in touching contact with one another throughout at least a portion of the matrix.

34. The composite material of claim 31, wherein the third particles are substantially homogeneously dispersed within the matrix, and wherein the network is locally continuous and adjacent third particles are in touching contact with one another throughout a localized portion of the matrix.

35. The composite material of claim 31, wherein the third particles are substantially homogeneously dispersed within the matrix, and wherein the network is continuous and adjacent third particles are in touching contact with one another throughout the matrix.

36. The composite material of claim 31, wherein a portion of the third particles are in touching contact with adjacent third particles and comprise an interconnected network of third particles within the matrix.

37. The composite material of claim 31, wherein the first particle oxidation potential is about 0.7 volts or more, and the third particle oxidation potential is about 0.5 volts or less.

38. The composite material of claim 31, wherein the microstructure of the matrix is an as-cast microstructure.

39. The composite material of claim 31, wherein the first metal comprises a magnesium-base alloy.

40. The composite material of claim 39, wherein the magnesium-base alloy comprises an Mg—Si, Mg—Al, Mg—Zn, Mg—Mn, Mg—Al—Zn, Mg—Al—Mn, Mg—Zn—Zr, or Mg—X alloy, where X comprises a rare earth element, or an alloy thereof, or any other combination of the aforementioned.

41. The composite material of claim 40, wherein the third metal particles comprise Ni, Fe, Cu, or Co, or an alloy thereof, or any combination thereof.

42. The composite material of claim 31, wherein the second particles have a density of about 0.1 to about 4.0 g/cm3.

43. The composite material of claim 31, wherein the metal second particles comprise hollow metal particles.

44. The composite material of claim 31, wherein the metal second particles comprise pure Ti or a Ti alloy.

45. A selectively degradable article, comprising:

a lightweight, selectively degradable composite material comprising a first matrix of a first metal comprising Mg, Al, Mn, or Zn, or an alloy of any of the above, or a combination of any of the above, having a first oxidation potential, a second powder, the second powder comprising low-density ceramic, glass, cermet, intermetallic, metal, polymer, or inorganic compound second particles, and a third metal powder, the third metal powder comprising third metal particles having an oxidation potential that is different than the first oxidation potential, the composite material having a microstructure comprising:

the matrix of the first metal; and the second particles and third particles dispersed within the matrix, the third particles comprising a network of third particles extending throughout the matrix, the lightweight, selectively degradable composite material having a density of about 3.5 g/cm3 or less.

46. The article of claim 45, wherein the composite material comprises a selectively degradable downhole article.

47. The article of claim 46, wherein the selectively degradable downhole article comprises a selectively degradable flow inhibition tool or component.

48. The article of claim 47, wherein the selectively degradable flow inhibition tool or component is selected from the group consisting of a frac plug, bridge plug, wiper plug, shear out plug, debris barrier, atmospheric chamber disc, swabbing element protector, sealbore protector, screen protector, beaded screen protector, screen basepipe plug, drill in stim liner plug, inflow control device plug, flapper valve, gaslift valve, transmatic plug, float shoe, dart, diverter ball, shifting/setting ball, ball seat, plug seat, dart seat, sleeve, teleperf disk, direct connect disk, drill-in liner disk, fluid loss control flapper, shear pin, screw, bolt, and cement plug.

49. The article of claim 45, wherein the article is used in a method comprising at least partially inhibiting a fluid flow in a wellbore.

* * * * *